US005259197A

United States Patent [19]

Byung-Mu

[11] Patent Number: 5,259,197

[45] Date of Patent: Nov. 9, 1993

[54] COMPRESSION TYPE HEAT PUMP

[75] Inventor: Lee Byung-Mu, Suwon, Rep. of Korea

[73] Assignee: Samsung Electronics Co., Ltd., Suwon, Rep. of Korea

[21] Appl. No.: 883,369

[22] Filed: May 15, 1992

[30] Foreign Application Priority Data

May 15, 1991 [KR] Rep. of Korea ..... 91-6963

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS 3,600.886 8/1971 Jaspers ..... 62/6
4,429,536 2/1984 Leach ..... 62/6
4,514,979 5/1985 Mohr ..... 62/6
5,056.316 10/1991 Chung ..... 62/6

*Primary Examiner*—Ronald C. Capossela

*Attorney, Agent, or Firm*—Burns, Doane, Swecker & Mathis

[57] ABSTRACT

The present invention relates to a compression type heat pump which can obtain cooling and heating output by way of pressure changes in gases, comprising a casing member formed with a housing space outside a guiding spacer, which is constituted for first and second displacers to reciprocate up and down smoothly; a low temperature heat exchanger which generates cooling output, being housed in lower area of housing space of said casing member; a low temperature heat regenerator which emits and discharges heat, being placed on the upper area of said low temperature heat exchanger; an intermediate temperature heat exchanger which generates heating output, being placed on the upper area of said low temperature heat regenerator; an intermediate temperature heat regenerator which discharges or absorbs heat, being layed on the upper area of said intermediate temperature heat exchanger, and the lid fixed to the upper area of said casing member.

8 Claims, 6 Drawing Sheets

COMPRESSION TYPE HEAT PUMP

BACKGROUND OF THE INVENTION

1. Field of the Invention

The present invention relates to a compression type heat pump, which can obtain cooling and heating output by way of the pressure changes of gases wherein the inner part of the void filled with such gases as hydrogen or helium gas is composed of high temperature void part, intermediate temperature void part and low temperature void part, and more particularly to a compression type heat pump which can improve efficiency even with miniaturization of the size.

2. Description of the Prior Art

In general, such compression type heat pump as can obtain heating and cooling output was suggested by this applicant in Korean laid patent application Ser. No. 90-18442 (application date of Nov. 4, 1990 ) entitled "Vuilleumier heat pump".

This kind of conventional vuilleumier heat pump (hereinafter called as compression type heat pump), as illustrated in FIG. 1 and 2, comprises a cylinder 42' having lots of heating tubes 39' and two displacers 45', 46' operating up and down with inner phase difference a hot temperature chamber 47', an intermediate temperature chamber 48' and a low temperature chamber 49, each separately constructed by the said displacers 45', 46' in the cylinder and each having a void (space) of different temperature;

a heat regenerative part 33' mounted on the external side of said cylinder 42' and connected respectively to said chambers 47', 48', 49';

a driving part mounted on the lower area of said cylinder 42', and driven by a motor 36' for driving said displacers 45', 46'.

The conventional compression type heat pump thus constructed, however, used to have drawbacks of causing the size of compression type heat pump to be unnecessarily bigger due to dead space being formed between operating part 32' and heat regenerator 33' and causing degradation of heat efficiency in heating and cooling due to excessive heat loss as well, because the operating part 32' having a high temperature chamber 47', intermediate temperature chamber 48' and low temperature chamber 49' and the heat regenative part 33' installed with heat regenerators 51', 52' are separately connected to a coupling tube 53'.

Another drawback of the conventional compression type heat pump is that the size tends to be big and the efficiency comes down due to heating tube 39' and heat regenerative part 33' being connected by the coupling tube 53'.

In other words, due to operating part 32', heat regenerative part 33' and heating tube 39' being separately connected to coupling tube 53', dead space is caused to form, the size of compression type heat pump goes big unnecessarily, resulting in degradation of thermal efficiency.

Furthermore, there have been various disadvantages, including the drop in productivity and excessive time consumption of manufacturing due to welding when operating part 32', heat regenerative part 33' and heating tube 39' are respectively connected to coupling tube 53'.

It is therefore, a main object of the present invention to provide an improved compression type heat pump in consideration of the numerous conventional disadvantages by miniaturizing the size, minimizing thermal loss and upgrading the efficiency.

Another object of the present invention is to provide an improved compression type heat pump which can be easily manufactured for mass production, thus upgrading the productivity.

In order to achieve above objects as provided by the present invention of compression type heat pump, the conventional compression type heat pump having a driving part equipped with a motor and a crank shaft, and NOS. 1 & 2 displacers reciprocating up and down according to the crank shaft mounted onto said driving part with a phase difference in between is added by:

a casing member with a housing space formed outside of a guiding space which has been made to guide said NOS. 1 & 2 displacers to reciprocate up and down smoothly;

a low temperature heat exchanger being established at the lower area of a housing space formed in said casing member and being composed of various low temperature fin members and low temperature connecting tube for generating cooling output;

a low temperature heat regenerative means which absorbs and emits the heat for said low temperature heat exchanger to generate cooling output, while seated on the top area of said low temperature heat exchanger, and while housed in said housing space, being composed of metal mesh having large heat capacity;

an intermediate temperature heat exchange which generates heating output, being composed of various intermediate temperature fin members and intermediate heat regenertive means and being housed in said housing space;

an intermediate temperature regenerative means which absorbs or emits the heat for said intermediate temperature heat exchanger to generate heating output while seated on the top area of space, being composed of metal mesh having large heat capacity;

a lid member which transfers heat for the inner part of said casing member to be hermetically sealed by being fixed to said casing member and for the gas in high-temperature spatial member of said casing member to keep in hot temperature.

According to the above construction, the housing space having low temperature heat exchanger, low temperature heat regenerator, intermediate temperature heat exchanger and intermediate temperature heat generator, and the guiding space which guides for NOS. 1 & 2 displacers to reciprocate up and down smoothly are so formed in one piece with the casing member that there is no dead space, causing the size to be miniaturized, the thermal loss to be minimized, the heat efficiency to be enhanced, the manufacturing to be easy, the mass production to be possible and the productivity to be upgraded as well.

DESCRIPTION OF THE PREFERRED EMBODIMENTS

An embodiment of the present invention, utilized in the compression type heat pump will be described in the following, with reference to the drawings.

Figure 1:
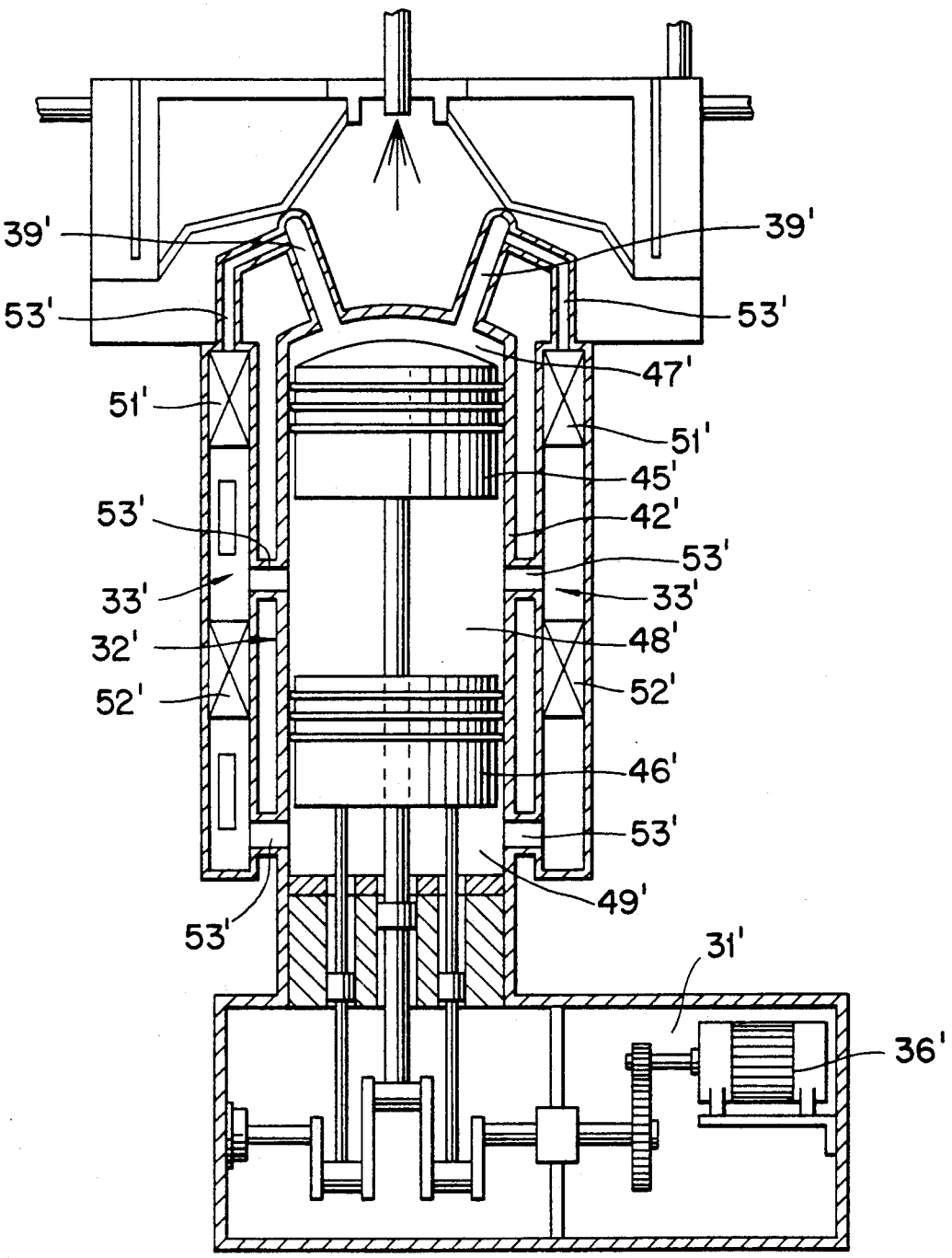
FIG. 1 (PRIOR ART)
Figure 2:
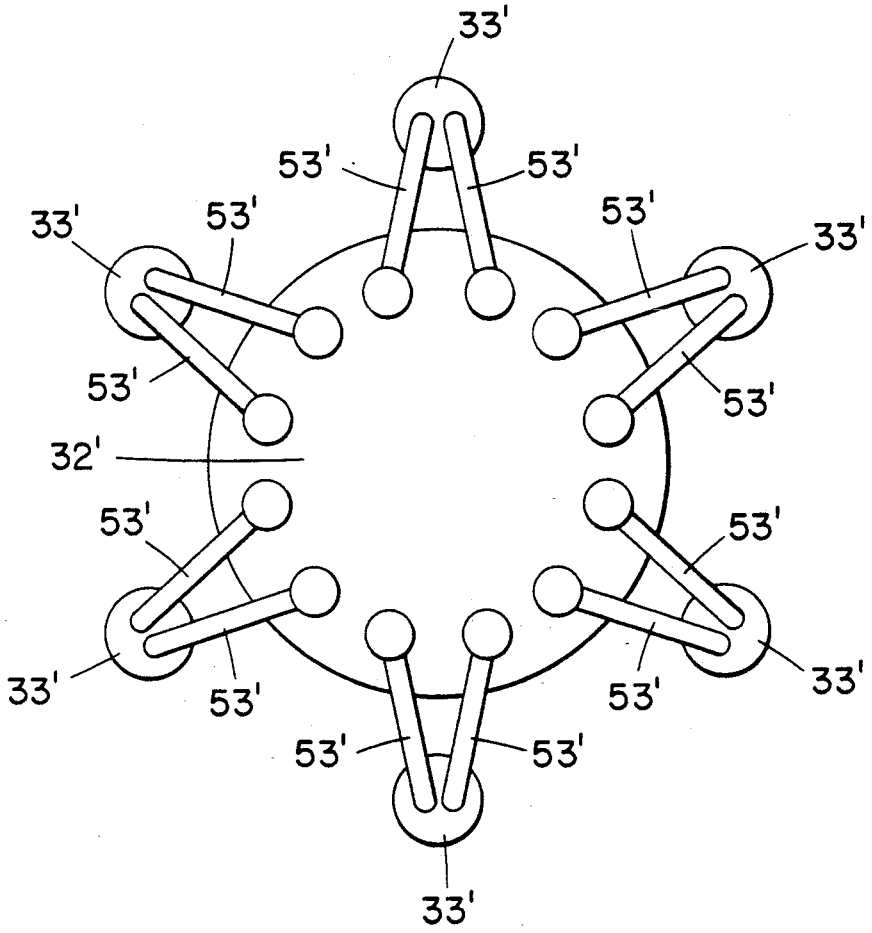

In FIG. 3 thru FIG. 10, (10) is a driving part which generates power to obtain initial start of compression type heat pump or to obtain high-powered cooling and heating, comprising:

a case 11 forming the external appearance with a protruding part 17 on one side of top area;

a motor 12 internally installed in said case 11 which generates power when a supply of power is given;

a coupling 13 connected to the motor shaft of said motor 12, transferring power generated from said motor 12;

a crank shaft 16 being rotated by the power of said motor 12, wherein one end is connected to said coupling 13, and the other end is connected to one inner side of said case 11 and general, a first or NO. 1 crank 14 is formed at center with a second or NO. 2 crank 15 forming on both sides of NO. 1 crank 14; and a bearing 18 supporting for smooth rotation of said crank shaft 16.

meanwhile, NOS. 1 & 2 cranks 14, 15 of said crank shaft 16, are formed within the scope of 60° C.-110° C. of the center axis of the crank shaft 16 and the protruding part 17 of said case 11 is attached by NOS. 1 & 2 guiding parts 21, 22.

Furthermore, NO. 1 crank 14 formed on said crank shaft 16 has one end of NO. 1 connecting rod 23 which transforms reciprocating movement to rotational movement and NO. 2 crank 15 formed on both sides of said NO. 1 crank 14 is connected to one end of NO. 2 connecting rod 24.

In the drawing, (25) is NO. 1 displacer, (26) is NO. 2 displacer formed with a hole through the center wherein the lower area of NO. 2 displacer 26 is attached to the other end of said NO. 2 connecting rod while the lower area of said NO. 1 displacer 25 is secured with the other end of NO. 1 connecting rod 23.

In other words, one end of said NO. 2 connecting rod 24 is attached to NO. 2 crank 15 of said NO. 2 displacer 26 through NO. 2 guiding part 22 of said guiding member 20.

Here said NO. 2 displacer 26 is caused to reciprocate up an down by the power generated from said motor 12.

Meanwhile one end of said NO. 1 connecting rod 23 is connected to NO. 1 crank of said crank shaft 16 whereas the other end is fixed to the lower area of said NO. 1 displacer 25 through the perforated hole of NO. 1 guiding part 21 of said guiding member 20 and said NO. 2 displacer 26, which reciprocates the said NO. 1 displacer 25 up and down by way of the power generated from said motor 12.

Furthermore, as said NO. 1 displacer 25 and NO. 2 displacer 26 are formed with NO. 1 crank 14 and NO. 2 crank 15 of said crank shaft 16 maintaining a predetermined biased angle off the center, these displacers reprocicate up and down to have a certain phase difference.

Meanwhile, in FIG. 4, within a cylindrical shape there forms a cylindrical shape of guiding space 31 for said NO. 1 & 2 displacers 25, 26 to reciprocate up and down smoothly, and outside of this guiding space 31, there forms a casing member mounted with a housing space 32 having a heat exchanger (to be mentioned later) and a heat regenerator.

The guiding space 31 and housing space 32 are partitioned off by tapered-off top side of inner protruding part 33 while said housing space 32 is formed with inner protruding part 33 and external protruding part 34.

Figure 3:
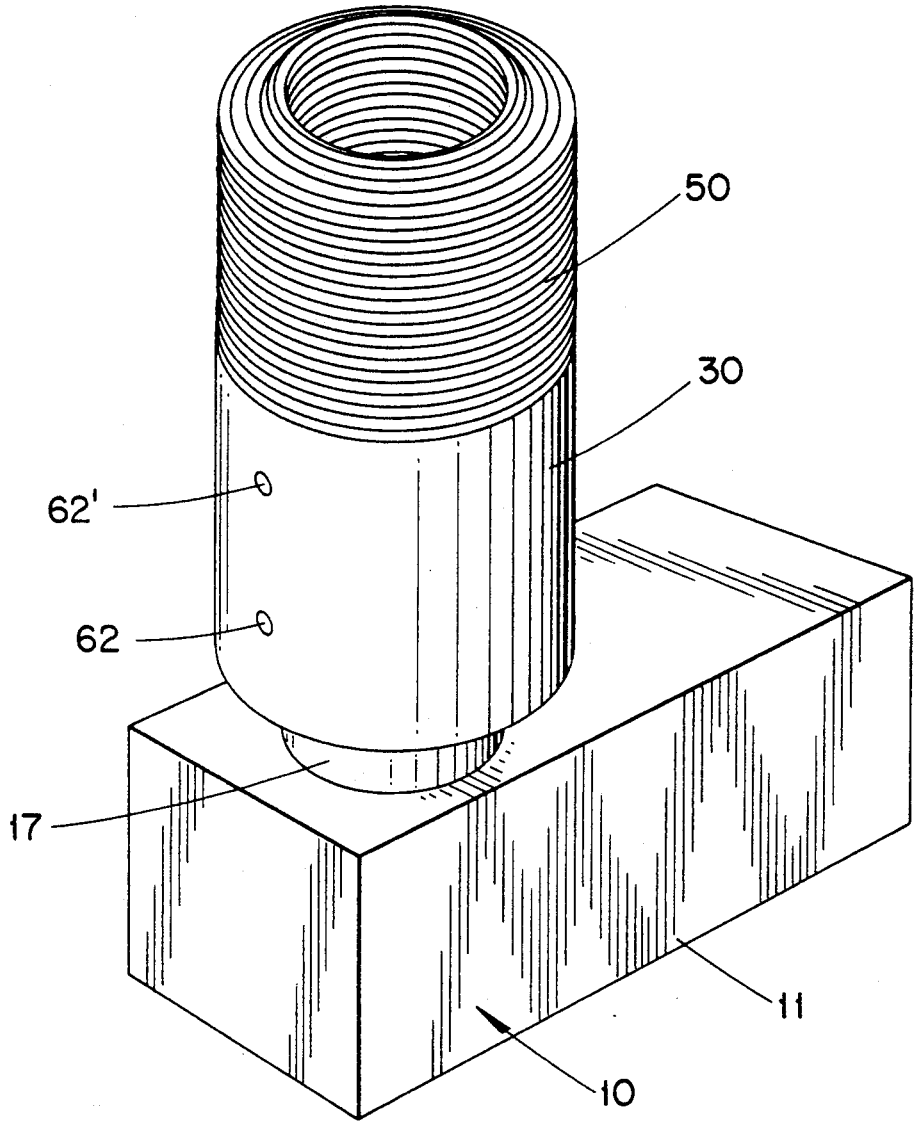
FIG. 3 is a perspective view of compression type heat pump in accordance with the present invention.
Figure 10:
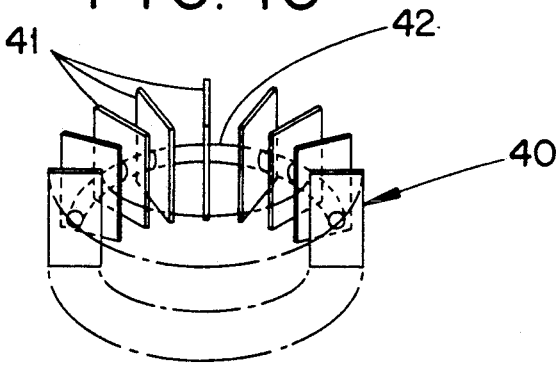
FIG. 10 is a fragmentary perspective view of partially-cut low temperature heat exchanger being applied to the present invention.

In the meantime, under the lower area of housing space 32 formed by inner protruding part 33 and external protruding part 34 of said casing member 30, as illustrated in FIG. 10, lies a low temperature heat exchanger 40, consisting of lots of low temperature fin members 41 made of materials having good conductivity and low temperature connecting tube 42.

on the top area of low temperature heat exchanger 40, as shown in FIG. 3, lies a low temperature heat regenerator 45 seated in said housing space 32, and stacked-up by metal mesh having good heat capacity for heat absorption or emission, causing said low temperature heat exchanger 40 to generate cooling output.

Furthermore, as a substitute for the inner protruding part 33 of said casing member, lots of notched grooves 61 are formed underneath for helium gas, hydrogen gas or the like (hereinafter referred to as gas) to be moved into said guiding space 31.

On the preset position of said external protruding part 34 (in other words, the place where low temperature connecting tubes 42 of low temperature heat exchanger 40 is situated) input orifice 62 is formed for the input means such as water supply pipe and the like to be connected.

On the opposite area of this input orifice 62 lies a discharge orifice 63.

Besides, on the upper area of said low temperature heat regenerator 45 located inside the said housing space 32 there forms an intermediate temperature heat exchanger 48 seated in said housing space 32, consisting of various intermediate temperature fin members 46 and intermediate temperature connecting tubes 47' for generating heating output. On the upper area of this intermediate temperature heat exchanger 48 lies an intermediate temperature heat regenerator 49 seated in said housing space 32, and stacked-up by metal mesh of good heat capacity for heat absorption or emission, causing said intermediate temperature heat exchanger 48 to generate heating output.

Figure 4:
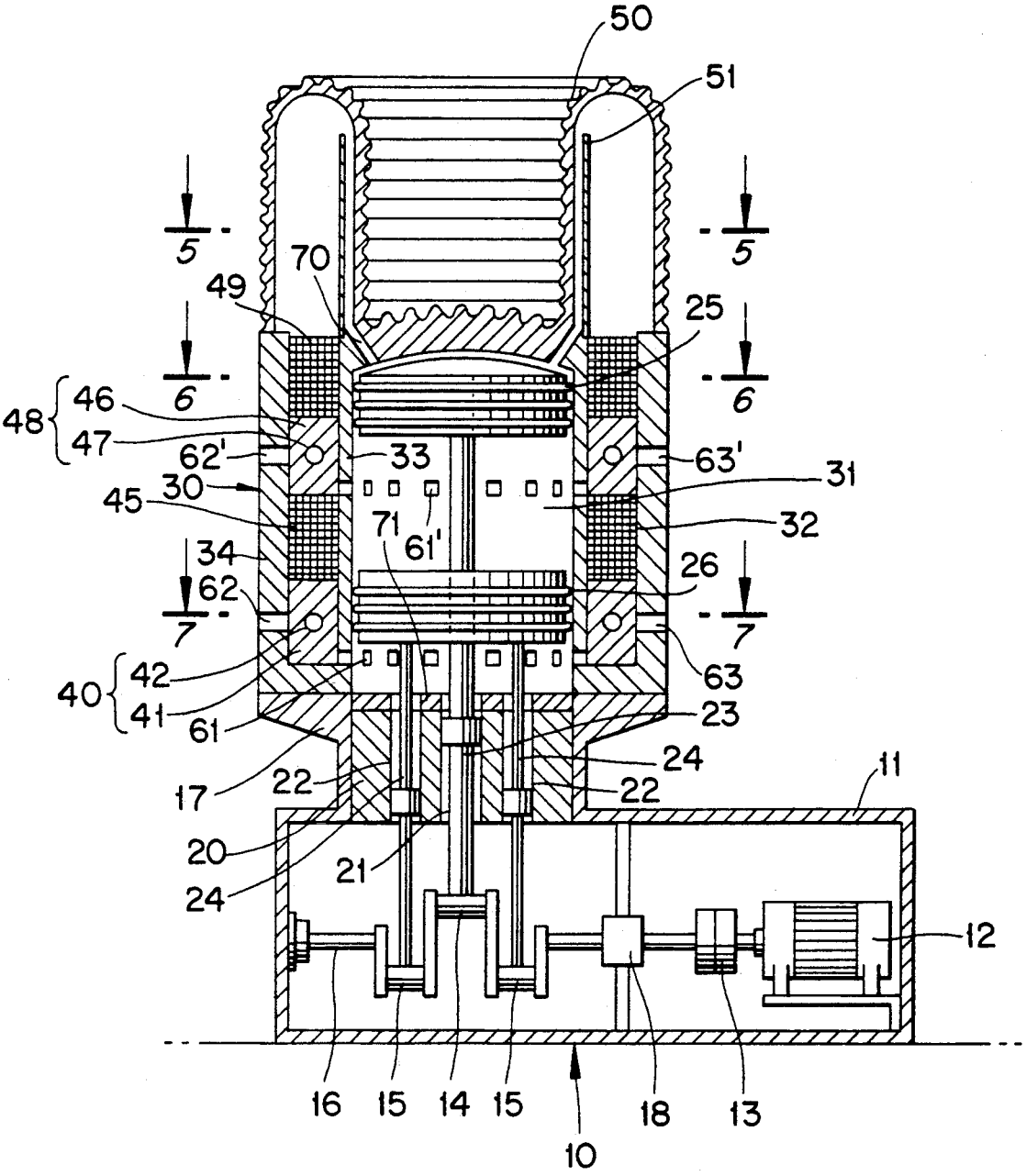
FIG. 4 is a sectional view of an inner section for the compression type heat pump in accordance with the present invention.
Figure 5:
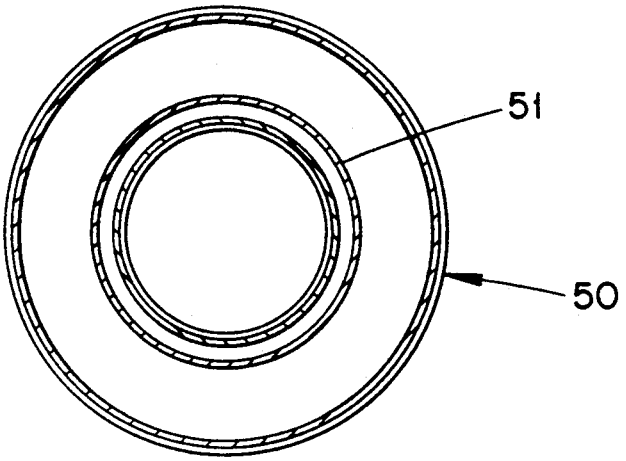
FIG. 5 is a sectional drawing showing a cut view of 5—5 portion of FIG. 4.
Figure 6:
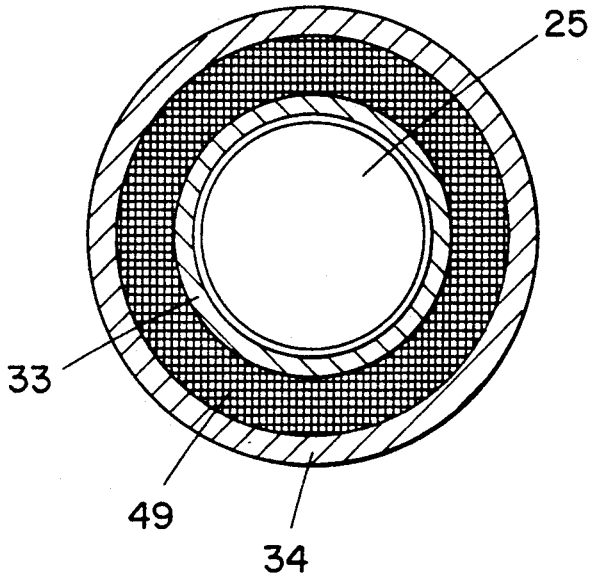
FIG. 6 is a sectional drawing which shows a cut view 6—6 portion of FIG. 4.
Figure 7:
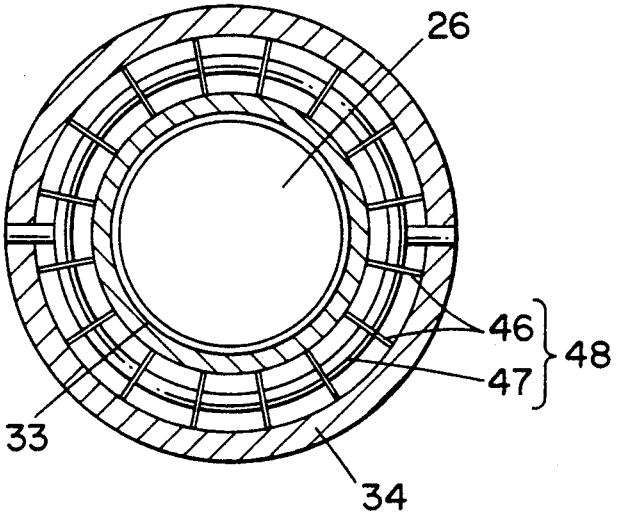
FIG. 7 is a sectional drawing illustrating a cut view of 7—7 potion of FIG. 4.
Figure 8:
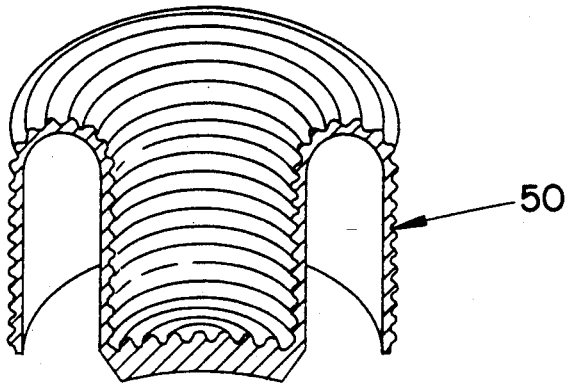
FIG. 8 is a fragmentary perspective view of partially-cut lid member being applied to the present invention.
Figure 9:
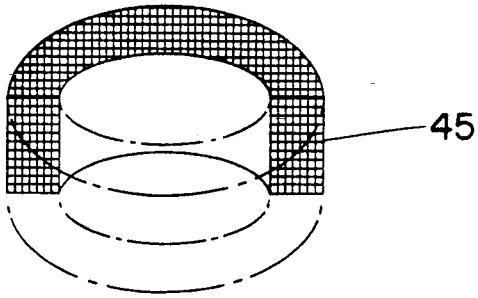
FIG. 9 is a fragmentary perspective view of partially-cut low temperature heat regenerator being applied to the present invention.

In addition, as a substitute for inner protruding part 33 of said casing member 30, lots of notched grooves 61' are formed in the upper, as illustrated in FIG. 4, for gas to be moved into said housing space 32 and guiding spacing 31.

In the predetermined position of said external protruding part 34 (namely, the place where intermediate temperature connecting tubes 47' of said intermediate temperature heat exchanger 48 is located) forms an input orifice 62' for the input means such as water supply pipe and the like (not shown) to be connected.

And in the opposite position of said input orifice 62' lies a discharge orifice 63, for heating output to be discharged.

Then, on the upper area of said casing member 30, lies a ring-shaped guiding member 51, and on the upper area of casing member 30 mounted with said guiding member 51, lies a lid 50 formed with lugs of rugged surface, which is fixed to said casing member 30 by welding and the like.

Meanwhile, between inner protruding part 33 installed on said casing member 30 and the lid 50 lies tapering upper side of said inner protruding part 33 and tapering inner lid, and, as per illustration in FIG. 4, a passage 70 is formed so that gas can be moved.

An unexplained code 71 on the drawing is a sealing member which is designed to prevent the gas accumulated in guiding space 31 from oozing out into driving part 10.

Here is how the compression type heat PUMP constructed as per the present invention works.

The inner space of said casing member 30 and the lid 50 is filled with helium or hydrogen gas or the like. The lid 50 is attached with a heater (not shown) for heating. If the lid is heated, the gas existing in guiding space 31 being partitioned by the inner space 31 of the lid 50 and the upper area of NO. 1 displacer 25 is heated by the heater and is kept in hot temperature.

At the moment, the gas existing in guiding space 31 being partitioned by the inner space of the lid 50 and the upper area of NO. 1 displacer 25 is heated smoothly and is kept in hot temperature if heated by the heater (not show) through the rugged surface of said lid 50 and the guiding member 51.

Accordingly, if the power is applied to the motor 12 of said driving part 10 when the gas existing in guiding space 31 being partitioned by the upper area of NO. 1 displacer 25 is maintained in hot temperature (approx. 600° C.-800° C.), NO. 1 & 2 displacers 25, 26 are caused to reciprocate up and down.

In other words, when said NO. 1 displacer 25 is moved to upper dead center, the hot air existing in the guiding space 31 (hereinafter called as high temperature space) being partitioned by the upper area of said NO. 1 displacer 25 is caused to pass through said intermediate heat regenerator 49 along the passage 70 formed by the lid 50 and inner protruding part 33.

At this point, as the hot gas being kept in high temperature space is passed through metal mesh of large heat capacity, causing hot gas heat to be absorbed by intermediate heat regenerator 49, the gas which has passed the intermediate heat regenerator 49 is supplied to intermediate heat exchanger 48 in a state of intermediate temperature of gas (100° C.-60° C.).

Namely, an intermediate heat exchanger 48 with various intermediate temperature fin members 46 being kept intermediate temperature (100° C.-600° C.) emits fluid or gas, through discharge orifice 631, being heated in intermediate temperature and flowing inside the intermediate connecting tubes 47 (in other words, hot output is generated.)

Furthermore, when said NO. 1 displacer 25 is moved toward bottom dead center or said NO. 2 displacer is moved toward upper dead center, the intermediate temperature of gas existing in the guiding space 31 (hereinafter referred to as intermediate temperature space. ) Partitioned by the lower area of said NO. 1 displacer 25 and upper area of said NO. 2 displacer 26 is moved to intermediate heat exchanger 48 through notched groove 61'formed in said inner protruding part 33, and some of the intermediate temperature gases are moved to high temperature space through said intermediate temperature heat regenerator 49 and the lid 50.

And the other intermediate temperature gases are moved to low temperature heat exchanger 40 through said low temperature heat regenerator 45.

Namely, some intermediate temperature gases passing through said intermediate temperature heat regenerator 49 are moved to the lid 50 and become high temperature gases, taking out the heat accumulated in intermediate temperature heat regenerator 49. The other intermediate temperature gases, being passed through said low temperature heat regenerator 45, change to low temperature gases (−10° C.-0° C.) and stored in heat exchanger 40.

At this moment, as the temperatures of various low temperature fins 41 in low temperature heat exchanger 40 change to low temperature, the fluids or gases flowing inside low temperature connecting tubes 42 change into low temperature and are discharged through discharge orifice 63 (namely, cooling output is obtained).

Besides, when said NO. 2 displacer 26 is moved to bottom dead center, the low temperature gases existing in the guiding space 31 (hereinafter called as low temperature space) partitioned by the lower area of NO. 2 displacer 25 are moved to low temperature heat regenerator 45 along the low temperature heat exchanger 40 through notched groove 61 formed inside said inner protruding part 33.

At this point, as the low temperature gas passing through low temperature heat regenerator 45 goes through low temperature heat regenerator 45, usurping the heat accumulated in low temperature heat regenerator 45, the low temperature gases which have passed the low temperature heat regenerator 45 change into low temperature.

As explained in the above, the compression type heat pump in accordance with the present invention has outstanding features of being miniaturized in size, minimized in heat loss for improved heat efficiency, easy in production causing mass production to be possible for improved productivity, and is composed of:

a low temperature heat exchanger generating cooling output;

a low temperature regenerator emitting or absorbing heat for said low temperature heat exchanger to generate cooling output;

an intermediate temperature heat exchanger generating hot output;

a housing space having intermediate temperature regenerator which absorbs or emits heat for said intermediate temperature heat exchanger to generate hot output;

a one-piece casing member which guides NO. 1 & 2 displacers to reciprocate up and down smoothly and causes guiding space consisting of low temperature, intermediate temperature and high temperature space in accordance with NOS. 1 & 2 displacers to have no dead space.

What is claimed is:

1. A compression type heat pump having a driving part equipped with a motor and a crank shaft and having first and second displacers reciprocating up and down at a predetermined phase difference made by said crank shaft, comprising:

a casing member forming a guiding space which guides the first and second displacers to reciprocate up and down smoothly, the casing member also forming a housing space outside of the guiding space;

a low temperature heat exchanger which generates cooling output, comprising low temperature fin members and low temperature connecting tubes and mounted in a lower area of the housing space;

a low temperature heat regenerator which emits or absorbs heat for said low temperature heat exchanger to generate cooling output, being housed in said housing space upon said low temperature heat exchanger and formed with large heat capacity of metal mesh or the like;

an immediate temperature heat exchanger which generates hot output and being seated upon said low temperature heat regenerator and housed in said housing space, and comprising intermediate temperature fin members and intermediate connecting tubes;

an intermediate temperature heat regenerator which emits or absorbs heat for said intermediate temperature heat exchanger to generate hot output, being seated upon said intermediate temperature heat exchanger and being housed in said housing space, and being formed with large heat capacity of metal mesh and the like;

a lid which transmits heat for the gases in a high temperature region of said casing member to be kept in high temperature, being fixed to an upper area of said casing member for hermetically sealing the inner area of said casing member.

2. A compression type heat pump according to claim 1, wherein said casing member has a tapering inner protruding part on an upper side thereof which partitions said guiding space and housing space.

3. A compression type heat pump according to claim 1 or 2 wherein the housing space of said casing member is formed with an inner protruding part and an external protruding part.

4. A compression type heat pump according to claim 2, wherein lower and upper areas of said inner protruding part are formed with a plurality of notched grooves for conducting gases to be moved to said housing space and guiding space.

5. A compression type heat pump according to claim 1, wherein said casing member has an external protruding part which includes input orifices for connecting input means, and discharge orifices for conducting cooling and heating outputs to be discharged.

6. A compression type heat pump according to claim 1, wherein said casing member is equipped with a guiding member for guiding gases existing in the high temperature region of said guiding space.

7. A compression type heat pump according to claim 1, wherein said lid has rugged protruding heat exchange lugs on an outer surface thereof.

8. A compression type heat pump according to claim 1, wherein said casing member has an inner protruding part, a passage being formed between said inner protruding part and said lid member for conducting gases.

* * * * *